US005936595A

United States Patent [19]

Wang

[11] Patent Number: 5,936,595

[45] Date of Patent: Aug. 10, 1999

[54] INTEGRATED ANTENNA PHASE SHIFTER

[75] Inventor: Johnson J.H. Wang, Marietta, Ga.

[73] Assignee: Wang Electro-Opto Corporation, Marietta, Ga.

[21] Appl. No.: 08/857,135

[22] Filed: May 15, 1997

[51] Int. Cl.[6] ..... H01Q 1/36

[52] U.S. Cl. ..... 343/895; 343/821

[58] Field of Search ..... 343/778, 754, 343/821, 895

[56] References Cited

U.S. PATENT DOCUMENTS

| | | | |
|---|---|---|---|
| 3,555,554 | 1/1971 | Kuo | 343/895 |
| 3,906,514 | 9/1975 | Phelan | 343/895 |
| 3,925,784 | 12/1975 | Phelan | 343/895 |
| 4,287,603 | 9/1981 | Moser | 343/895 |
| 4,905,011 | 2/1990 | Shea | 343/895 |
| 5,293,172 | 3/1994 | Lamberty et al. | 343/815 |
| 5,313,216 | 5/1994 | Wang et al. | 343/700 |
| 5,508,710 | 4/1996 | Wang et al. | 343/726 |

OTHER PUBLICATIONS

Johnson J.H. Wang, Characteristics of a New Class of Diode–Switched Integrated Antenna Phase Shifter, Jan. 1983, IEEE Transactions on Antennas and Propagation, vol., AP–31, No. 1, pp. 156–159.

H. Richard Phelanm, Spiraphase Reflectarray, Microvave Journal, Jul., 1977, pp. 47–50.

H. Richard Phelan, Spiraphase Reflectarray, Microwave Journal, Jul., 1977, pp. 67–71.

H. Richard Phelan, Spiraphase —A New, Low, Cost, Lightweight Phased Array, Microwave Journal, Dec., 1976, pp. 41–44.

H. Richard Phelan, Dual Polarized Spiraphase, Microwave Journal, pp. 37–40, Mar. 1977.

*Primary Examiner*—Don Wong
*Assistant Examiner*—Tan Ho
*Attorney, Agent, or Firm*—Thomas, Kayden, Horstemeyer & Risley, L.L.P.

[57] ABSTRACT

The present invention provides an integrated antenna and phase shifter which has frequency-independent performance. In its preferred form, the antenna phase shifter of the present invention comprises first and second conductive spirals which are identical to and aligned with each other and which are separated from each other by a thin sheet of dielectric material. The first spiral has arms which are connected in a central region of the spiral to a first line of a balun or a balanced transmission line via electronic or optoelectronic switches. The second spiral has arms which are connected in the central region of the second spiral to a second line of the balun or balanced transmission line via electronic or optoelectronic switches. A switching circuit is used to turn them on and off. When any one of the RF switches is turned on, an RF link is established between the arm connected to the switch and the line of the balun connected to the switch. When one of the arms of one of the spirals is turned on, the associated arm in the adjacent spiral is RF coupled to the arm which is turned on due to the proximity effect. The RF switches are switched on and off by the switching circuit in such a manner that the spirals are in effect being electrically rotated. Frequency phase shifts in increments of $2\pi/N$ radians can be achieved, where N is the number of arms in each spiral.

16 Claims, 8 Drawing Sheets

PROPRIETARY

RF VOLTAGES ON SPIRAL OF A 2-BIT, HYBRID SWITCH SMM ANTENNA/PHASE-SHIFTER (ALTERNATE VERSION DUAL SPIRAL FOR STATE #1)

| | SPIRAL F | | | SPIRAL G | | |
|---|---|---|---|---|---|---|
| SPIRAL ARM | SWITCH STATUS | RF VOLTAGE | SOURCE | SWITCH STATUS | RF VOLTAGE | SOURCE |
| ARM #1 | ON | $V\angle 0^\circ$ | DIRECT FROM LINE F | OFF | $V\angle 0^\circ$ | RF COUPLING * FROM ARM #1 OF SPIRAL F |
| ARM #2 | ON | $V\angle 0^\circ$ | DIRECT FROM LINE F | OFF | $V\angle 0^\circ$ | RF COUPLING * FROM ARM #2 OF SPIRAL F |
| ARM #3 | OFF | $V\angle 180^\circ$ | RF COUPLING * FROM ARM #3 OF SPIRAL G | ON | $V\angle 180^\circ$ | DIRECT FROM LINE G |
| ARM #4 | OFF | $V\angle 180^\circ$ | RF COUPLING * FROM ARM #4 OF SPIRAL G | ON | $V\angle 180^\circ$ | DIRECT FROM LINE G |

- $V_F = V\angle 0^\circ$ AND $V_G = V\angle 180^\circ$ AT THE OUTPUT OF THE BALUN LINES (LINES F AND G CONNECTED TO SPIRALS F AND G, RESPECTIVELY)

FIG. 6

| STATE | FET SWITCHES | | | | | | | | DIODE SWITCHES | | | | | | | |
|---|---|---|---|---|---|---|---|---|---|---|---|---|---|---|---|---|
| | F1f/ F1b | F2f/ F2b | F3f/ F3b | F4f/ F4b | G1f/ G1b | G2f/ G2b | G3f/ G3b | G4f/ G4b | F-1 | G-1 | F-2 | G-2 | F-3 | G-3 | F-4 | G-4 |
| 1 | ON/ OFF | OFF/ ON | OFF/ ON | OFF/ ON | OFF/ ON | OFF/ ON | ON/ OFF | OFF/ ON | ON | OFF | OFF | OFF | OFF | ON | OFF | OFF |
| 2 | OFF/ ON | ON/ OFF | OFF/ ON | OFF/ ON | OFF/ ON | OFF/ ON | OFF/ ON | ON/ OFF | OFF | OFF | ON | OFF | OFF | OFF | OFF | ON |
| 3 | OFF/ ON | OFF/ ON | ON/ OFF | OFF/ ON | ON/ OFF | OFF/ ON | OFF/ ON | OFF/ ON | OFF | ON | OFF | OFF | ON | OFF | OFF | OFF |
| 4 | OFF/ ON | OFF/ ON | OFF/ ON | ON/ OFF | OFF/ ON | ON/ OFF | OFF/ ON | OFF/ ON | OFF | OFF | OFF | ON | OFF | OFF | ON | OFF |

FIG. 7

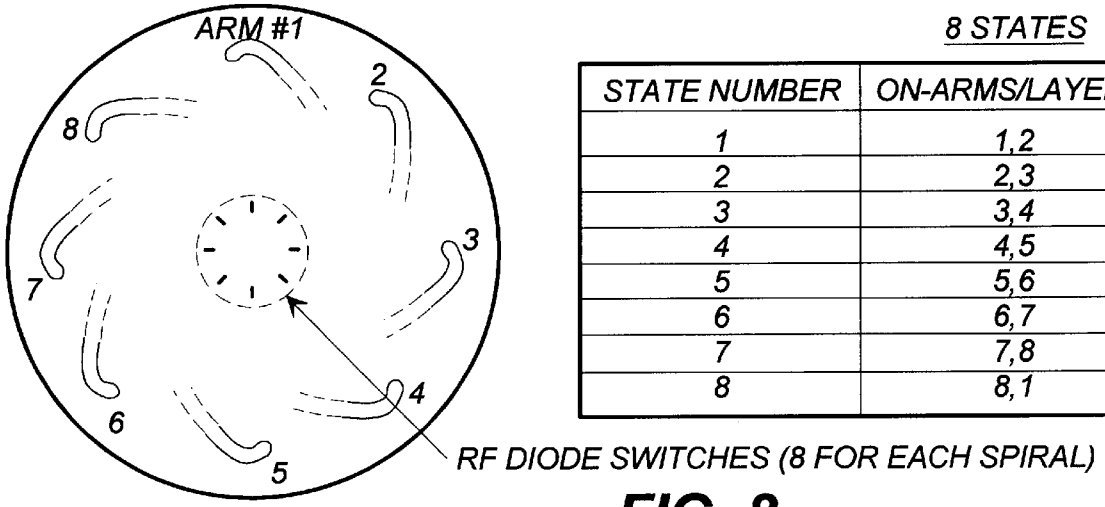

8 STATES

| STATE NUMBER | ON-ARMS/LAYER F | ON-ARMS/LAYER G |
|---|---|---|
| 1 | 1,2 | 5,6 |
| 2 | 2,3 | 6,7 |
| 3 | 3,4 | 7,8 |
| 4 | 4,5 | 8,1 |
| 5 | 5,6 | 1,2 |
| 6 | 6,7 | 2,3 |
| 7 | 7,8 | 3,4 |
| 8 | 8,1 | 4,5 |

FIG. 8

3-BIT (8 STATES, 8 ARMS)

| STATE NUMBER | ON ARMS/LAYER F | ON ARMS/LAYER G |
|---|---|---|
| 1 | 1,2,3,4 | 5,6,7,8 |
| 2 | 2,3,4,5 | 6,7,8,1 |
| 3 | 3,4,5,6 | 7,8,1,2 |
| 4 | 4,5,6,7 | 8,1,2,3 |
| 5 | 5,6,7,8 | 1,2,3,4 |
| 6 | 6,7,8,1 | 2,3,4,5 |
| 7 | 7,8,1,2 | 3,4,5,6 |
| 8 | 8,1,2,3 | 4,5,6,7 |

2-BIT (4 STATES, 4 ARMS)

| STATE NUMBER | ON ARMS/LAYER F | ON ARMS/LAYER G |
|---|---|---|
| 1 | 1,2 | 3,4 |
| 2 | 2,3 | 4,1 |
| 3 | 3,4 | 1,2 |
| 4 | 4,1 | 2,3 |

INTEGRATED ANTENNA PHASE SHIFTER

AN INTEGRATED ANTENNA PHASE SHIFTER

The invention was made with Government support under a contract from the U.S. Navy. The Government has certain rights in the invention.

TECHNICAL FIELD OF THE INVENTION

The present invention relates to antennas and phase shifters and, more particularly, to an integrated, spiral-mode microstrip (SMM) antenna which can be phase shifted photonically and/or electronically and which is frequency independent.

BACKGROUND OF THE INVENTION

Frequently independent antennas, such as spiral antennas, are well known in the antenna industry. They are often used in applications where it is desirable to have a radiation pattern and impedance which remain fairly constant over a wide range of frequencies. An important characteristic of this planar type of antenna is its complementary structure. Between the strips of metal forming the arms of the spirals are strips of non-metal material. If the metal part of the antenna is the same as the non-metal part except for the angle of rotation, the antenna is said to be self-complementary. Self-complementary antennas of infinite extent have frequency-independent impedances.

Although the impedance, radiation pattern and polarization of spiral antennas generally remain fairly constant over a wide range of frequencies, factors such as the overall radius of the antenna, the flare rate of the spirals, and the feed point of the antenna affect performance. Generally, the low-frequency end of the operating band is imnited by the overall radius of the antenna while the high-frequency end is limited by the feed structure. Therefore, these factors, among others, must be taken into account when designing a spiral antenna.

A properly designed spiral antenna is a member of the class of self-complementary planar antennas, which have an inherently constant impedance that is virtually frequency independent. The spiral-mode microstrip (SMM) antenna, which generally comprises a self-complementary planar antenna having a ground plane added to one side thereof, represents a major improvement that allows the antenna to be compatible, mountable and conformable with any surface on which the antenna is to be placed. The SMM antenna is disclosed in U.S. Pat. No. 5,313,216, issued May 17, 1994 to J. J. H. Wang and V. K. Tripp, which is incorporated herein by reference.

The conformability of an antenna, i.e., the flexibility of an antenna to be molded to a surface having an arbitrary shape without being adversely affected in its performance, is an important factor to be considered when selecting or designing an antenna because antennas are often mounted on the surface of cars, aircraft, human body, etc.

An important class of antennas are phased arrays. Phased arrays have many antenna elements which can be phase shifted to produce beam steering. Phased arrays have two fundamental components, namely, the antenna elements and the phase shifters. Desirable features of phase shifters include fast switching speed, low insertion loss, wide bandwidth, and large power-handling capability. Electronic phase shifters are invariably narrow-band. It has long been recognized that there is a phase pattern associated with the wide-band spiral antenna. If one rotates a spiral antenna mechanically, a frequency-independent phase shift equal to the angle of mechanical rotation can be realized. As a result, a spiral antenna can simultaneously serve as both a radiating element and a phase shifter. Based on this principle, implementing spiral antennas as phased array elements began in the 1950s. These early phased arrays were based on electromechanical rotation to control the phase shift of each antenna element to steer the beam of a phased array comprised of a number of spiral antennas.

During the 1970s, attempts were made to develop electronically-steered "reflectarrays" which were steered by electronically switching the elements of the spiral antenna off and on to electrically rotate the reflected wave from the spiral. This was accomplished through the use of diodes which connected pairs of arms of the spirals in a short-circuit or open-circuit configuration depending on whether the diode is on or off. These arrays were discussed extensively in a four-part series in *Microwave Journal* (1976–1977) by H. R. Phelan. Although it was proclaimed that these arrays had the potential for low cost, low weight and frequency independence, these antennas did not exhibit broadband characteristics. This puzzling lack of bandwidth contrary to their theory and claim was later explained by Dr. Johnson J. H. Wang in "Characteristics of a New Class of Diode-Switched Integrated Antenna Phase Shifter", *IEEE TRANSACTIONS ON ANTENNAS AND PROPOGATION*, VOL. AP-31, NO. 1, January 1983. In this article, Dr. Wang demonstrated that a spiraphase antenna, when operating as a reflector in the spiraphase, does not have the broadband characteristics normally associated with the spiral antenna. Dr. Wang pointed out that, for broadband operation, the spiral must operate directly as a transmit and/or receive antenna rather than as a reflector in Phelan's design, but did not indicate how this could be accomplished.

However, Dr. Wang's approach, which is the invention disclosed in the present application, is difficult to implement. A multi-arm spiral must be connected to a feed network that divides a signal into N components (N being the number of spiral arms), with the $n^{th}$ component feeding the $n^{th}$ arm (n=1, 2, . . . N) having an equal amplitude but a relative phase of $2\pi m\ (n-1)/N$ radians, or 360 (n−1) m/N degrees, where m is the mode number of the spiral excitation. For example, the feed network of a 4-arm mode-1 spiral must be able to provide inputs of equal amplitude but 0°, 90°, 180° and 360° in phase to the four spiral arms in a clockwise or counterclockwise manner (for right-hand or left-hand circular polarization). Since the wideband phase shifter is difficult to implement, the practical advantage of the integrated antenna phase shifter would greatly diminish if a wideband phased feed network was required to be employed in the design. Therefore, a technique is needed which allows the basic concept of the integrated antenna phase shifter to be realized and which is practical and efficient.

The integrated antenna phase shifter of the present invention can be used, in addition to those systems using phased arrays, as an antenna and modulator for telecommunications. In particular, the antenna phase shifter of the present invention provides a digital phase switching feature which is directly applicable to digital modulation using phase shift keying (PSK) techniques such as binary PSK, quadrature PSK, etc.

SUMMARY OF THE INVENTION

The present invention is based first on the existence of a spatial phase pattern in certain antennas, such as the spiral, given by exp jmϕ), where m is the spiral mode number and $\phi$ is the spatial angle about the axis of the antenna. For spiral antennas, a mechanical rotation about the antenna axis by an angle $\phi$ will shift the phase of the antenna by an amount equal to $m\phi$. For example, as this antenna is rotated by 45°, a phase shift of 45° is observed if this antenna is operated in the usual mode-1 (m=1). In accordance with the present invention, a broadband antenna phase shifter is provided which is frequency independent and which electronically shifts the phase of the antenna. The antenna of the present invention is comprised of at least two conductive arms. The arms have terminals at their proximal ends which are electrically coupled to a conductive member of a feed network via RF (radio frequency) switches. The switches are electrically coupled, via these arms, to a DC voltage supply outside the region of these arms. These RF switches are turned on or off by bias currents provided by the DC power supply controlled by a switching circuit. When the RF switch in a particular arm is turned on, RF power can propagate between the arm and a particular RF feed line, thus in effect causing the antenna to rotate electrically by way of a change of the path of the RF link, and thus the phase of the RF power received or transmitted through the antenna. Thus, in operation phase shifts are generated by turning the RF switches on and off in such a manner that the antenna element is electrically rotated.

The antenna elements preferably are spirals. In accordance with the preferred embodiment of the present invention, a first spiral comprising a plurality of arms is overlayed, and aligned, with a second spiral comprising an identical plurality of arms. The spirals are separated by a thin dielectric layer which provides DC isolation between the arms of the first spiral and the arms of the second spiral. The arms of the first spiral have terminals located at their proximal ends which are electrically coupled to a first line of a balun on the balanced side of the balun via switches, which preferably are diodes. The arms of the second spiral have terminals located at their proximal ends which are electrically coupled to a second line of the balun on the balanced side of the balun via switches, which preferably are diodes. The balun is connected on its unbalanced side to an unbalanced transmission line, such as a coaxial cable, leading to transmitter/receiver.

In order to turn the RE switches on and off, a bias-control current is electrically coupled to the RF switches. Preferably, this is accomplished by connecting the bias-control current to the distal ends of the spiral arms such that a bias voltage applied at the distal ends of the arms turns the RE switches on and off. Preferably, an electronic or optoelectronic bias-control switch is disposed near the distal end of each of the spiral arms for this purpose. The bias-control switches are connected to DC voltage supplies. The bias-control switches control the DC current flowing through the arms to either forward or reverse bias the diodes causing them to be turned on or off, respectively. When an arm of one of the spirals is turned on in this manner, the arm associated with it in the adjacent spiral is also RF coupled to the arm due to the proximity effect, which is a well known phenomenon. In accordance with the preferred embodiment, each spiral has four arms and only one arm is turned on in each spiral at any particular time.

In accordance with an alternative embodiment, two spirals are overlayed and aligned as discussed above. However, each spiral has eight arms and thus has a 3-bit phase shift. As alternative embodiments, one, two, three, or four of the arms in each of the spirals are in the "on" state due to forward bias and the other seven, six, five, or four arms, respectively, are in the "off" state due to reverse bias.

BRIEF DESCRIPTION OF THE DRAWINGS

FIG. 6 is a table illustrating the RF voltages and switch states and the source of RF excitation on each arm of the two spirals of a two-bit antenna phase shifter.

FIG. 7 is a table illustrating all of the switch states for the diodes (RF switches) and the FET (bias-control switches) for a two-bit antenna phase shifter in accordance with the present invention.

FIG. 8 schematically illustrates a three-bit antenna phase shifter in accordance with the present invention wherein eight-arm spirals are used to generate the phase shifts.

DETAILED DESCRIPTION OF THE INVENTION

Figure 1A:
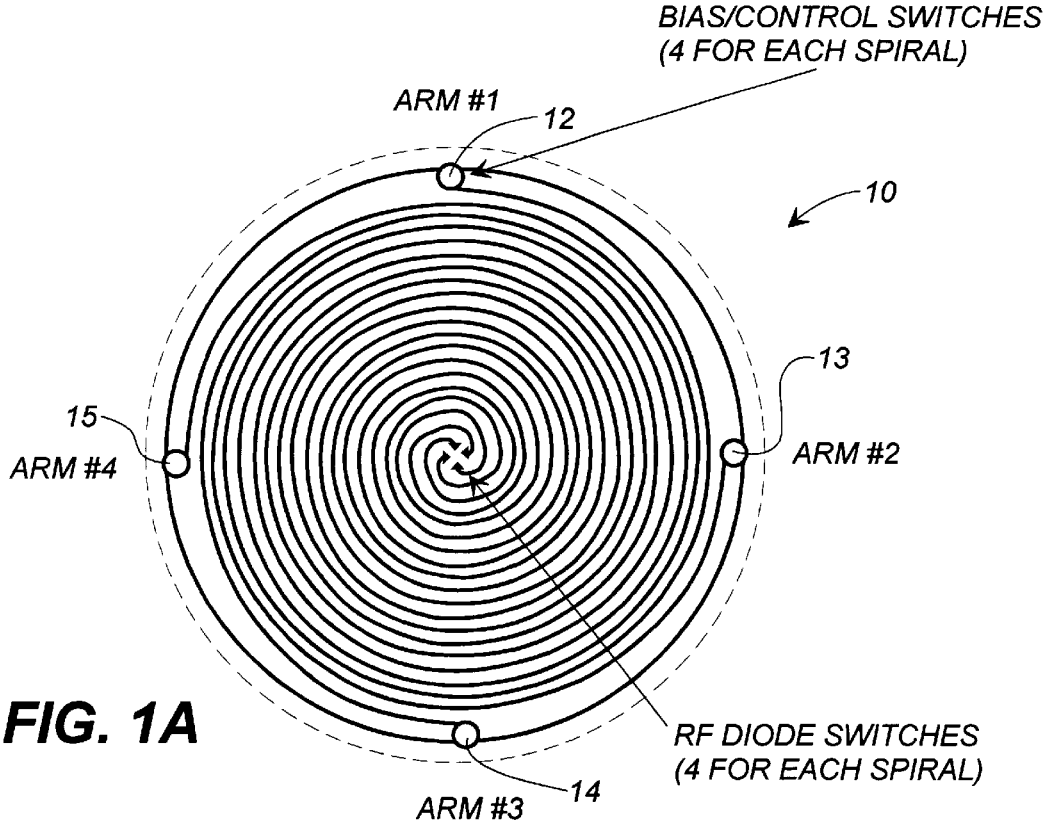
FIG. 1A is a schematic illustration of a top view of the antenna phase shifter of the present invention in accordance with a preferred embodiment.
Figure 1B:
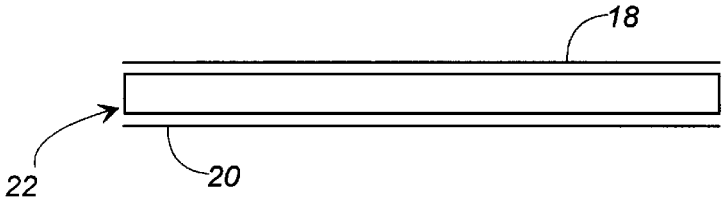
FIG. 1B illustrates a side view of the antenna phase shifter shown in FIG. 1A.

FIG. 1A schematically illustrates a top view of the preferred embodiment of the present invention. In accordance with this embodiment, a four-arm spiral 10 is employed to obtain a 2-bit phase shifter. The arms are connected to DC voltage supplies (not shown) via biascontrol switches 12, 13, 14 and 15. The terminals of the arms are electrically coupled to the balanced side of a balun via RF switches 17, which preferably are diodes, as discussed in more detail below. FIG. 1B illustrates a side view of the antenna shown in FIG. 1A. The side view of FIG. 1B illustrates that the antenna is comprised of two identical and aligned multi-arm spirals 18, 20 separated by a thin dielectric sheet 22. The thickness of the dielectric sheet will depend on the operating frequencies of the antenna, but generally will be electrically thin, e.g., less than 10 mils for operation in the 1 to 10 GHz range. The dielectric spacing provides DC isolation between the two spirals while allowing close RF coupling between them. The arms of the two spirals are aligned such that arm 1 of spiral 18 is directly over arm 1 of spiral 20, arm 2 of spiral 18 is directly over arm 2 of spiral 20, etc.

The antenna employed in the present invention, including its ground plane, its dielectric substrate, and other features not shown in the figures, preferably is substantially similar to the SMM antenna disclosed in U.S. Pat. No. 5,313,216, which, as stated above, is incorporated by reference into the present application. However, the antenna feed and the switching of the spiral employed by the present invention for generating the phase shifts are unique to the present invention.

Figure 2A:
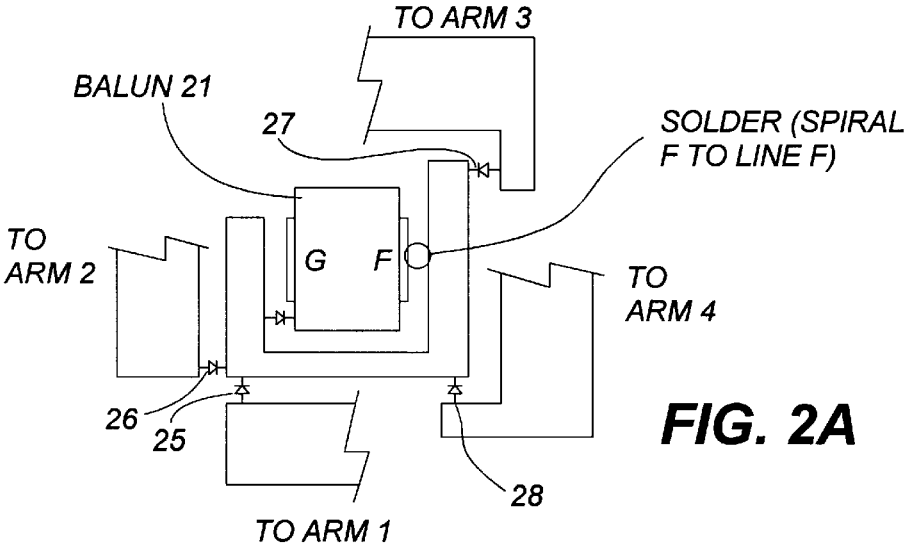
FIG. 2A is a schematic illustration depicting the connection of a first spiral to one line of a balun.
Figure 2B:
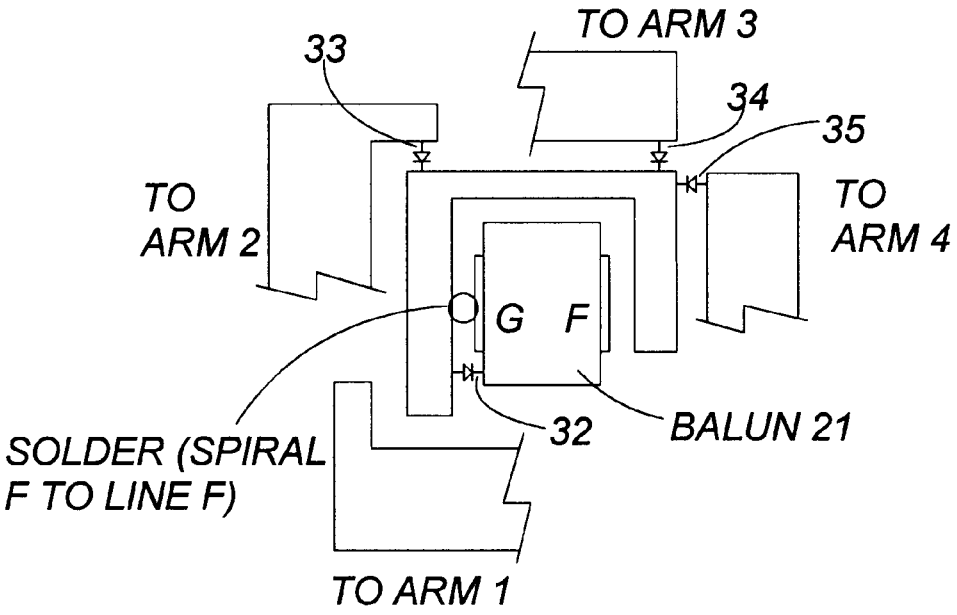
FIG. 2B is a schematic illustration depicting the connection of a second spiral to the other line of a balun.

The two spirals 18, 20 (also referred to as spirals F and G, respectively) are connected to lines F and G , respectively, of a balun 21, as shown in FIGS. 2A and 2B. A balun is a device that links an unbalanced transmission line, such as a coaxial cable line, with a balanced transmission line, such as the feed terminals of the spiral, while providing impedance matching at the input and output terminals of the balun. Thus, for a two-arm spiral, for example, a balun generally has a 50-ohm impedance on one end for connection to an unbalanced transmission line and a 120-ohm impedance on the other end to match the impedance of the balanced two-arm spiral with self-complementary structure, which normally is 120 ohms. On the two balanced output terminals of the balun, equal amplitudes and a phase difference of 180° between them can be achieved with high accuracy over a bandwidth of 10:1 or more. The high performance of the balun, which has been confirmed by testing, and the inherent phase pattern of a multi-arm spiral, makes it possible to create digital phase shifts in the present integrated antenna phase shifter. It should be noted that the balun could be replaced by, for example, a 180° hybrid.

The two lines leading to the balanced-line terminals of the balun are designated lines F and G. Line F is electrically coupled to the arms of spiral 18 via diodes 25, 26, 27 and 28, as shown in FIG. 2A. Line G is electrically coupled to the arms of spiral 20 via diodes 32, 33, 34 and 35, as shown in FIG. 2B. Line G of the balun generally is DC grounded, directly connected to the outer conductor of a coaxial cable which feeds the antenna. Line F of the balun is DC floating.

Figure 3:
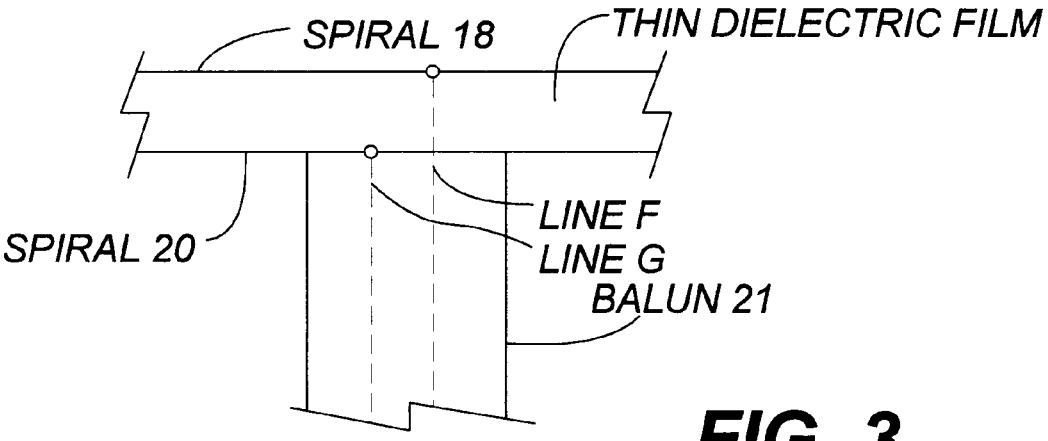
FIG. 3 illustrates schematically a side view of the first and second spirals connected to two lines of the balun.

When these RF diode switches are turned on by forward biasing them, the arms of the spirals will be RF connected to the corresponding balun line. FIG. 3 shows a side view of spirals 18 and 20 connected to the respective balun lines. When an arm of one spiral is RF connected by turning on its respective diode, the corresponding arm in the adjacent spiral will also be RF connected due to RF coupling between the two arms resulting from the close proximity of the two arms. As a result of the close proximity and alignment of the two spirals, the RF electrical currents on the two spirals will be closely coupled with each other so that these currents are nearly identical. Although it is not necessary for the proximity effect to be perfect, it is desirable for the total currents and fields for the combined spirals to be symmetrical between opposite spiral arms with respect to the center of the spiral. The proximity effect enables the two spirals to work as a single spiral through RF coupling.

Figure 4:
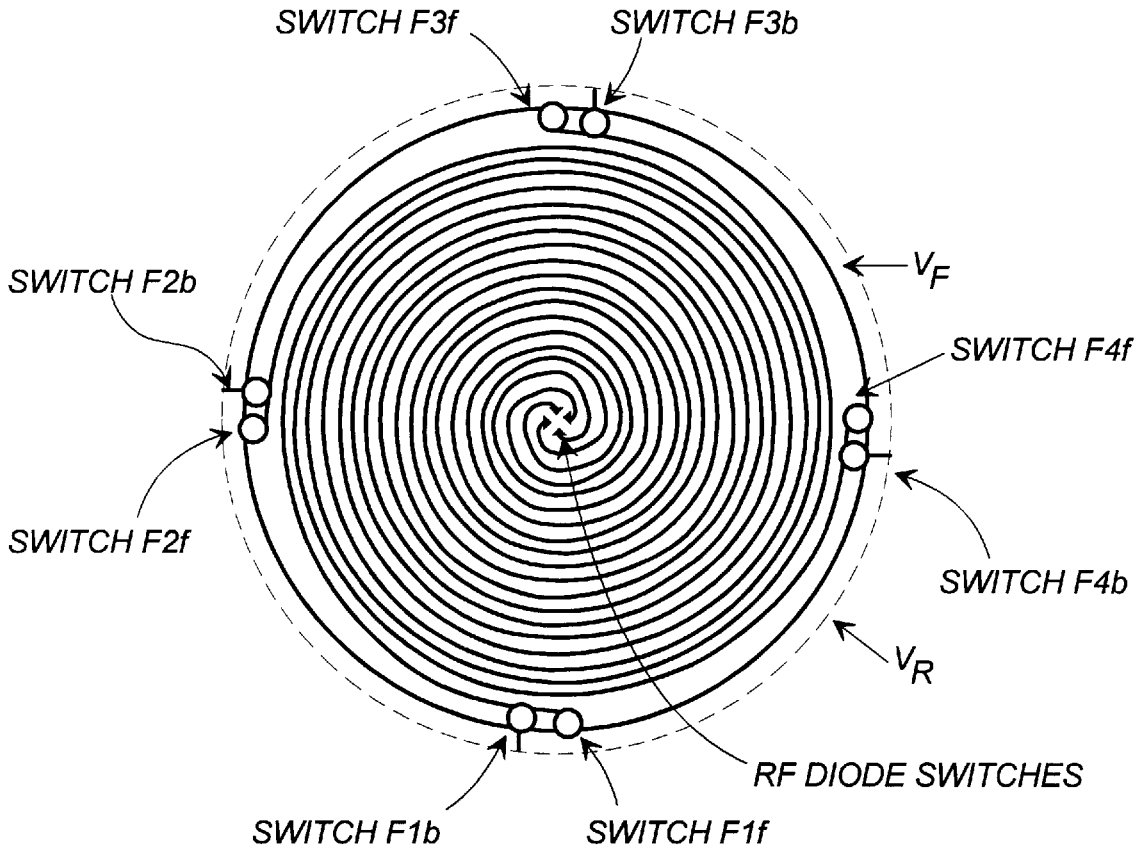
FIG. 4 schematically illustrates the locations of the bias-control switches (for forward and reverse biases) relative to the arms of the spirals.

In accordance with the preferred embodiment of the present invention, the biasing and control of the RF diode switches in the central feed region is accomplished via electronic or optoelectronic bias/control switches located at the ends of the spiral arms. However, it will be apparent to those skilled in the art that the present invention is not limited with respect to the location of the bias-control switching circuitry. It will also be apparent to those skilled in the art that the present invention is not limited with respect to the components employed by the bias-control circuitry. In accordance with the preferred embodiment of the present invention, the bias-control switches are connected to the distal ends of the spiral arms, as schematically illustrated for the top spiral in FIG. 4, which will be referred to hereinafter as spiral F because it is connected to line F of the balun. The reverse (or backward) biasing switches for arms 1–4 of spiral F are F1*b*, F2*b*, F3*b* and F4*b*, respectively. The forward biasing switches for arms 1–4 of spiral F are F1*f*, F2*f*, F3*f* and F4*f*, respectively. FIG. 4 is a top view of the antenna phase shifter of the present invention which shows only spiral F. It is important to note that these bias-control switches are located outside the radiation zone of the spiral so that they do not interfere with the RF path and radiation of the spiral. The voltages $V_F$ and $V_R$ are the appropriate forward and reverse biasing voltages to bias the diodes in the central feed region of the spirals. When the RF diode switch of one of the arms of spiral F is turned on by application of the forward biasing voltage $V_F$ to the arm by one of the bias/control switches, the arm will be electrically coupled to line F of the balun. When the diode of one of the arms of spiral F is reverse biased by applying the reverse biasing voltage $V_R$ to the RF diode switch, the diode switch will be turned off and the arm will not be RF connected to line F. The operations of the bias-control switches of the bottom spiral, which will be referred to hereinafter as spiral G, are similar in structure and operation to those of spiral F.

Figure 5:
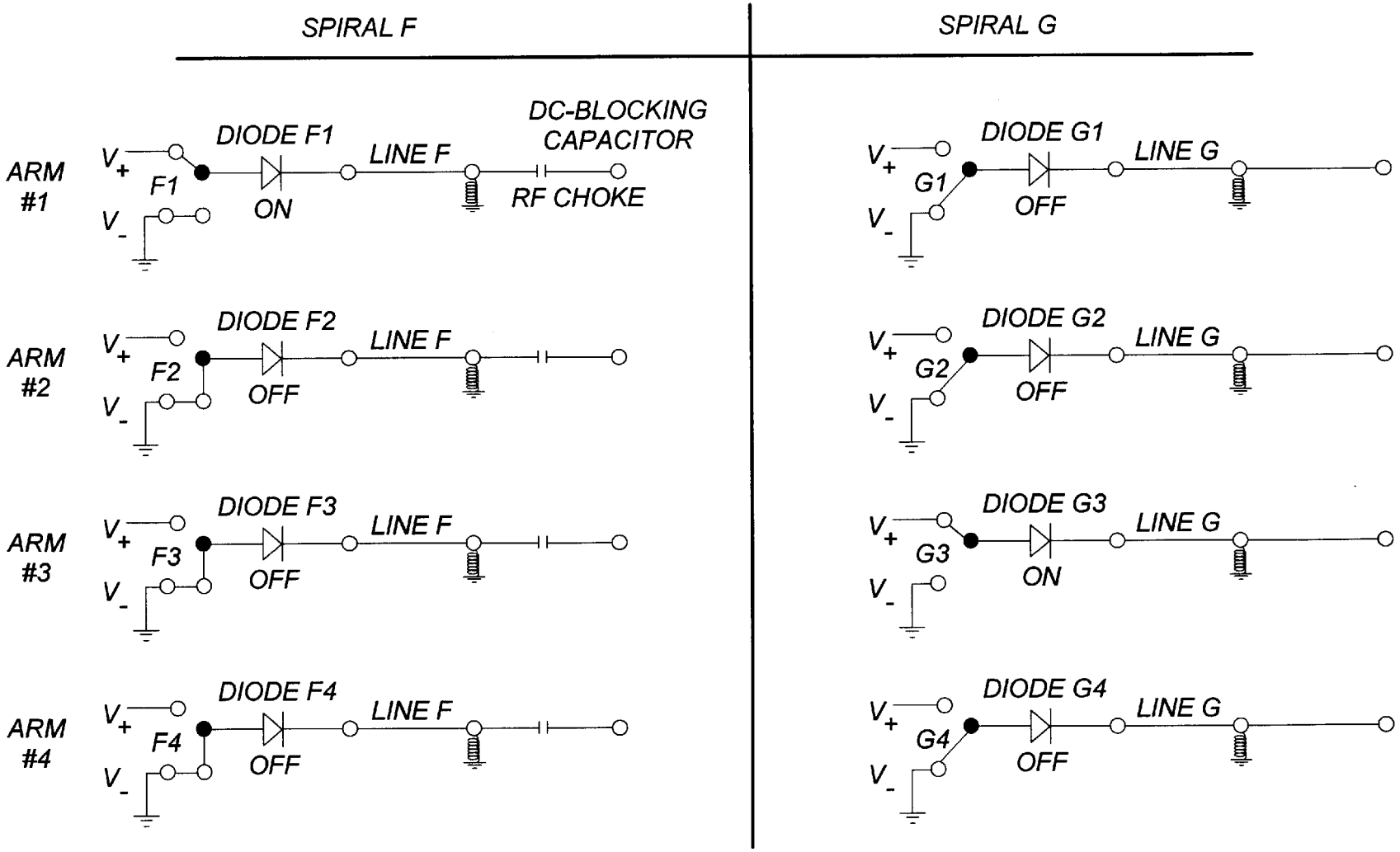
FIG. 5 schematically illustrates the circuit the DC current follows as it passes from the arms of the two spirals to the lines of the balun for a certain bias/control state.

FIG. 5 shows the schematic diagrams for the biasing circuits for each of the four arms of spirals F and G corresponding to a specific state of control or phasing of the antenna phase shifter. As is shown, the biasing current on line G returns directly to ground to complete the current loop. For the DC-floating line F of the balun, an RF choke and a DC-blocking capacitor must be added to provide the DC return path, so that the biasing current on line F can be channeled back to the source through the RF choke and stopped by the DC-blocking capacitor from entering the receiver/transmitter (not shown).

The RF voltages and switch states, as well as the source of RF excitation, for an alternate version in which two (instead of one) arms are on, are displayed in FIG. 6. It can be seen from this figure that when the diode of an arm of spiral F is forward biased, the diode of the corresponding arm of spiral G is reverse biased, and vice versa. However, when the diode of any arm of spiral F is forward biased, the corresponding arm of spiral G is RF coupled with the arm of spiral F, and vice versa. This is due to the proximity effect. A complete table of states for the diodes and the bias-control switches, for the basic design with only 1 of the 4 arms being on, is illustrated in FIG. 7. In accordance with this embodiment, the RF switches are the diodes and the bias-control switches for the diodes are field effect transistor (FEF) switches controlled electronically or optoelectronically. Switches F1*f* and F1*b* correspond to the forward and reverse (backward) biasing voltages, respectively, for diode F-1, which is the diode on arm 1 of spiral F. Switches F2*f* and F2*b* correspond to the forward and reverse biasing voltages, respectively, for diode F-2, which is the diode on arm 2 of spiral F. Switches F3*f* and F3*b* correspond to the forward and reverse biasing voltages, respectively, for diode F-3, which is the diode of arm 3 on spiral F. Switches F4*f* and F4*b* correspond to the forward and reverse biasing voltages, respectively, for diode F-4, which is the diode on arm 4 of spiral F. Switches G1*f* and G1*b* correspond to the forward and reverse biasing voltages, respectively, of diode G-1, which is the diode on arm 1 of spiral G. Switches G2*f* and G2*b* correspond to the forward and reverse biasing voltages, respectively, of diode G-2, which is the diode on arm 2 of spiral G. Switches G3*f* and G3*b* correspond to the forward and reverse biasing voltages, respectively, of diode G-3, which is the diode on arm 3 of spiral G. Switches G4*f* and G4*b* correspond to the forward and reverse biasing voltages, respectively, of diode G-4, which is the diode on arm 4 of spiral G.

As shown in FIG. 7, when the diode on arm 1 of spiral F is on, the diode on arm 3 of spiral G is also on, and vice versa. When the diode on arm 2 of spiral F is on, the diode on arm 4 of spiral G is on, and vice versa. When the diode on arm 3 of spiral F is on, the diode on arm 1 of spiral G is on, and vice versa. When the diode on arm 4 of spiral F is on, the diode on arm 2 of spiral G is on, and vice versa.

For the antenna phase shifter comprising the four arm spirals discussed above, phase shifts in increments of 90° are achieved, which is referred to as a 2-bit phase shifter. It should be noted that the present invention is not limited with respect to the number of arms comprised by the spirals. In accordance with the present invention, antenna phase shifters of 1, 3, 4, 5, etc., bits can be designed in the manner discussed above with respect to the 2-bit antenna phase shifter. A 3-bit antenna phase shifter will have 8 arms and will generate phase shifts in increments of 45°. A 4-bit antenna phase shifter will have 16 arms and will generate phase shifts in increments of 22.5°. A 5-bit antenna phase shifter will have 32 arms and will generate phase shifts in increments of 11.25°. Thus, the antenna phase shifter of the present invention will generate phase shifts in increments equal to $360°/2^n$, where n is the number of bits of the antenna phase shifter and $2^n$ is the number of spiral arms of each spiral comprising the antenna phase shifter. FIG. 8 schematically illustrates a 3-bit antenna phase shifter designed in accordance with the present invention wherein 8-arm spirals are used to generate the 3-bit phase shifts.

In the case of 1-bit integrated antenna phase shifter, a two-arm spiral is needed. Each of the two spiral arms is connected, via an RF switch to one of the two terminals of a balanced transmission line. Thus, there will be only two (2) states depending on the RF path selected via the RF switches. The switching is, in effect, a reverse of the polarity of the transmission line, or equivalently, the two spiral arms, thus achieving 180° phase shift. An application of the 1-bit integrated antenna is BPSK (Binary Phase Shift Keying) in digital modulation.

It should be noted that the use of a balun in the present design is not needed if the feed network to the spiral is a balanced transmission line, in which case the designer merely has to match the impedance between the antenna and the feed network. The balanced transmission line has an inherent 180° phase shift between the two lines (in the form of positive and negative lines, so to speak), and is generally used at lower RF frequencies (VHF and below).

Figure 9:
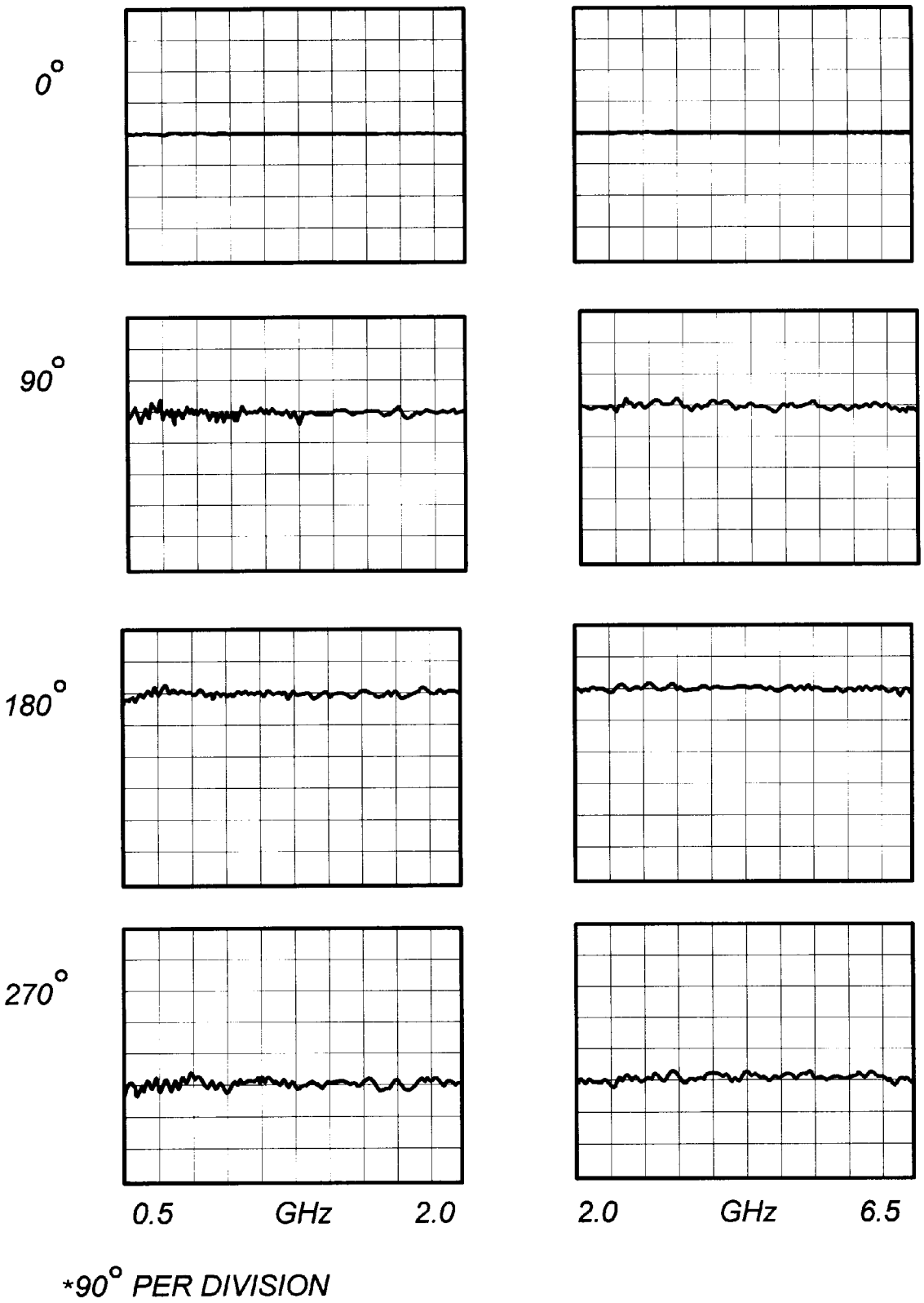
FIG. 9 illustrates measurements obtained during testing of a two-bit antenna phase shifter in accordance with the present invention.

FIG. 9 demonstrates measurements which were obtained during testing of the 2-bit SMM antenna phase shifter of the present invention. FIG. 9 shows measured phases for the 0, 90, 180 and 270-degree states over the 500 to 6500 MHz frequency range. As illustrated by this figure, very low rms phase errors of 2 to 5 degrees are achieved over a 10:1 bandwidth. Thus, it can be seen that the SMM antenna phase shifter of the present invention remains frequency independent over a broadband frequency range.

Figures 10, 11:
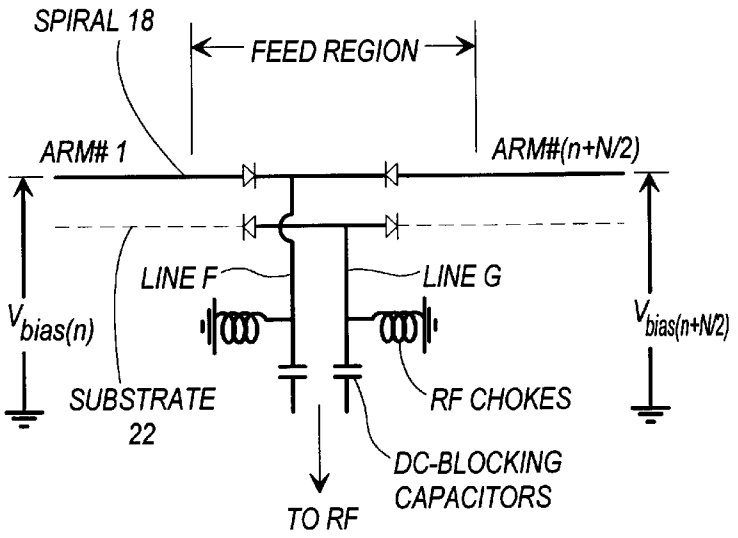
FIG. 10 shows two tables summarizing the "on" arms of both spirals for each of the states for 2-bit and 3-bit antenna phase shifters.
FIG. 11 illustrates an alternative embodiment of the present invention wherein the two spirals, F and G, shown in FIG. 1B have been combined into, or replaced by, a single spiral.

In accordance with the embodiments discussed above, at any moment in time, no more than one arm of each of the two spirals is directly excited by the DC current. However, the proximity effect makes the two overlaying spirals function electrically as a single spiral, even though only one arm in either spiral is directly excited at any particular time. FIG. 10 is a table showing the switch status of the spiral arms in accordance with an alternative embodiment of the present invention wherein a plurality of arms of each spiral of the 3-bit SMM antenna phase shifter similar to that schematically illustrated in FIG. 8, and of the 2-bit SMM antenna phase shifter similar to that schematically illustrated in FIGS. 1A and 1B, are excited simultaneously. In accordance with this embodiment, preferably all four arms of each spiral are RF excited simultaneously. The differences in impedance and other RF characteristics between the preferred form of the invention discussed above with respect to FIG. 2 and the alternate form of the invention discussed above with respect to FIG. 10, and briefly in FIG. 7, can be utilized to optimize the phase shifting performance of the antenna phase shifter of the present invention. One advantage of keeping half of the arms of a spiral on and half of them off is that the spiral becomes truly self-complementary, from the viewpoint of RF fields, and thus more capable of exhibiting the frequency-independent impedance inherent in self-complementary planar antennas. In general, the number of arms to be turned on can be anywhere from one to one half of the total number of arms in a spiral.

In accordance with another embodiment of the present invention, a single spiral is used instead of the dual-spiral design discussed above. In accordance with this embodiment, each arm of the spiral is connected to a feed network for both RF and bias currents. The bias current return can be provided in the same manner as that of spiral F and line F, as shown in and discussed above with reference to FIG. 2A. It will be understood by those skilled in the art that many other bias-control circuits can be assembled which combine a balun or 180° hybrid with a multi-arm spiral to generate the phase switching in increments of $2\pi/N$ radians (360/N degrees) in the present invention, where N is the number of arms of the spiral of the antenna phase shifter. For example, the two spirals, F and G, can be combined into (or replaced by) a single spiral 18 disposed on a substrate 22 and having a small feed region at the center of the spiral 18, as shown schematically in FIG. 11. In this configuration, all the spiral arms are electrically coupled to either line F or line G. Although two diodes are shown for each arm, they can be combined, and implemented, as a single RF switch for each arm. Preferably, half are coupled to line F and the opposite half are coupled to line G. However, this configuration may be limited with respect to its power handling capability. The large RF voltage swing may turn on a diode that is reverse biased at a low bias voltage of the same magnitude for both forward and reverse biasing. This embodiment illustrates the possibility that many single-spiral or pseudo-single-spiral antenna phase shifter can be achieved which are within the spirit and scope of the present invention.

It should be noted that the present invention has been described with respect to illustrative embodiments but that the present invention is not limited to these embodiments. For example, the present invention is not limited with respect to the number of arms comprised by the spiral or spirals or with respect to the switching status of the arms. It should also be noted that the present invention is not limited with respect to the types of spirals used. Any self-complimentary planar antenna having a spatial phase pattern is potentially suitable for use with the present invention. However, it will be apparent to those skilled in the art that antenna designs other than those specifically enumerated may also be suitable for use with the present invention. It will be apparent to those skilled in the art that other modifications may be made which are within the spirit and scope of the present invention.

It should also be noted that the present design can be readily adapted to spirals that are fed at the distal ends of the spiral arms, rather than the usual proximal ends of the spiral arms, by those skilled in the art.

It should also be noted that the RF switches can be of the optoelectronic bias-free switches. In such a case, no bias circuit is needed and the spiral arms are optically controlled and switched to have the desired phase shifts. Experiments have been conducted to show that this is indeed feasible by having PV-FET (photovoltaic FET) switches. However, at present the PV-FET switches are limited to low RF power. By using photodiodes instead of PV-FET switches the power-handling limitation can be overcome. However, photodiodes require a large amount of optical power, which is a disadvantage.

What is claimed is:

1. An antenna phase shifter for connection to a balanced transmission line comprising a first conductive line and a second conductive line, said antenna phase shifter comprising:

a thin layer of dielectric material having a top surface and a bottom surface;

a conductive antenna element disposed on the top surface of said layer of dielectric material, said conductive antenna element being a planar frequency-independent antenna having a spatial phase pattern, wherein said conductive antenna element is comprised of at least first and second conductive arms, each of said conductive arms having a proximal end and a distal end, wherein the proximal ends of the conductive arms are disposed in proximity to one another in a central region of said conductive antenna element;

a first RF switch connected between the proximal end of said first conductive arm and said first conductive line;

a second RF switch connected between the proximal end of said second conductive arm and said first conductive line;

a third RF switch connected between the proximal end of said first conductive arm and said second conductive line;

a fourth RF switch connected between the proximal end of said second conductive arm and said second conductive line;

a first bias control switch connected to the distal end of the first conductive arm, the first bias control switch selectively applying a bias voltage to the distal end of the first conductive arm;

a second bias control switch connected to the distal end of the second conductive arm, the second bias control switch selectively applying the bias voltage to the distal end of the second conductive arm; and said conductive arms being selectively coupled to the first and second conductive lines via the first, second, third, and fourth RF switches by the application of the bias voltage to the distal ends of the first and second conductive arms, the first and second conductive arms being selectively coupled to the first and second conductive lines to radiate and receive an RF signal, the RF signal having phase shifts in increments of $2\pi/N$ radians, where N equals the number of conductive arms comprised by said conductive antenna element.

2. The antenna phase shifter of claim 1 wherein said conductive antenna element further comprises:

third and fourth conductive arms, said third and fourth conductive arms each having a proximal end and a distal end, wherein the proximal ends of the third and fourth conductive arms are disposed in proximity to one another in a central region of said conductive antenna element;

a fifth RF switch connected between the proximal end of said third conductive arm and said first conductive line; and a sixth RF switch connected between the proximal end of said fourth conductive arm and said first conductive line;

a seventh RF switch connected between the proximal end of said third conductive arm and said second conductive line;

an eighth RF switch connected between the proximal end of said fourth conductive arm and said second conductive line;

a third bias control switch connected to the distal end of the third conductive arm, the third bias control switch selectively applying the bias voltage to the distal end of the third conductive arm;

a fourth bias control switch connected to the distal end of the fourth conductive arm, the fourth bias control switch selectively applying the bias voltage to the distal end of the fourth conductive arm; and said third and fourth conductive arms being selectively coupled to the first and second conductive lines via the fifth, sixth, seventh, and eighth RF switches by the application of the bias voltage to the distal ends of the third and fourth conductive arms, the third and fourth conductive arms being selectively coupled to the first and second conductive lines to radiate and receive an RF signal, the RF signal having phase shifts in increments of $2\pi/N$, where N equals the number of conductive arms comprised by said conductive antenna element.

3. The antenna phase shifter of claim 1 wherein said RF switches are diodes.

4. The antenna phase shifter of claim 1 wherein said RF switches are optoelectronic switches.

5. An antenna phase shifter for connection to a balanced transmission line comprising a first conductive line and a second conductive line, said antenna phase shifter comprising:

a thin layer of dielectric material having a top surface and a bottom surface;

a first conductive antenna element disposed on the top surface of said layer of dielectric material, said first conductive antenna element being a planar frequency-independent antenna with a phase pattern, said first antenna element comprised of at least first and second conductive arms, each of said arms having a proximal end and a distal end, wherein the proximal ends of said arms are disposed in proximity to one another in a central region of said first antenna element;

a first RF switch connected between the proximal end of said first arm and said first conductive line;

a second RF switch connected between the proximal end of said second arm and said first conductive line;

a second conductive antenna element, said second conductive antenna element being disposed on the bottom surface of said layer of dielectric material, said second antenna element being a planar frequency-independent antenna identical to and aligned with said first conductive antenna element, wherein said second conductive antenna element is comprised of at least first and second conductive arms, each of said arms of said second antenna element having a proximal end and a distal end, the proximal ends of the arms of said second antenna element being disposed in proximity to one another in a central region of said second antenna element;

a third RF switch connected between the proximal end of said first arm of said second antenna element and said second conductive line;

a fourth RF switch connected between the proximal end of said second arm of said second antenna element and said second conductive line; and a switching circuit electrically or optoelectrically coupled to said RF switches via the distal ends of said conductive arms, wherein said switching circuit turns said RF switches on and off in such a manner that selected conductive arms of each antenna element are variably connected to and disconnected from the conductive lines, to which said conductive arms are coupled via said RF switches, by the RF switches directly and by proximity effect between the aligned conductive arms of the first and second antenna elements, to achieve phase shifts in increments of $2\pi/N$ radians, where N equals the number of conductive arms comprised by either conductive antenna element of said antenna phase shifter.

6. The antenna phase shifter of claim 5 further comprising:

third and fourth conductive arms comprised by said first conductive antenna element, each of said third and fourth conductive arms having a proximal end and a distal end, wherein the proximal ends of said third and fourth conductive arms are disposed in proximity to one another in a central region of said first antenna element;

a fifth RF switch connected between the proximal end of said third arm of said first antenna element and said first conductive line;

a sixth RF switch connected between the proximal end of said fourth arm of said first antenna element and said first conductive line;

third and fourth conductive arms comprised by said second conductive antenna element, said third and fourth arms of said second antenna element being identical to and aligned with said third and fourth arms of said first antenna element, each of said arms of said second antenna element having a proximal end and a distal end, wherein the proximal ends of said third and fourth arms of said second antenna element are disposed in proximity to one another in a central region of said second antenna element;

a seventh RF switch connected between the proximal end of said third arm of said second antenna element and said second conductive line;

an eighth RF switch connected between the proximal end of said fourth arm of said second antenna element and said second conductive line; and wherein said switching circuit is also electrically or optoelectrically coupled to the distal ends of said fifth, sixth, seventh and eighth RF switches, wherein said switching circuit turns said RF switches on and off in such a manner that said conductive arms are variably connected to and disconnected from the conductive lines, to which said conductive arms are coupled via said RF switches, by the RF switches directly and by proximity effect between the aligned conductive arms of the first and second antenna elements, to achieve phase shifts in increments of $2\pi/N$ radians, where N equals the number of conductive arms comprised by either antenna element of said antenna phase shifter.

7. The antenna phase shifter of claim 5 wherein said RF switches are diodes.

8. The antenna phase shifter of claim 5 wherein said RF switches are optoelectronic switches.

9. An antenna phase shifter comprising:

a thin layer of dielectric material having a top surface and a bottom surface;

a first conductive antenna element disposed on the top surface of said layer of dielectric material, said first conductive antenna element being a planar frequency-independent antenna with a spatial phase pattern and comprised of at least first and second conductive arms, each of said conductive arms having a proximal end and a distal end, wherein the proximal ends of the conductive arms are disposed in proximity to one another in a central region of said first conductive antenna element;

an antenna feed for electrically coupling an unbalanced transmission line to said first conductive antenna element, said antenna feed comprising a balun or 180° hybrid, said antenna feed having a first conductive member and a second conductive member, said first and second conductive members providing excitations of equal amplitudes but 180° out of phase;

a first RF switch connected between the proximal end of said first conductive arm and said first conductive member;

a second RF switch connected between the proximal end of said second conductive arm and said first conductive member;

a second conductive antenna element, said second conductive antenna element disposed on the bottom surface of said layer of dielectric material, said second conductive antenna element comprised of at least first and second conductive arms and being identical to and aligned with said first antenna element, each of said conductive arms of said second conductive antenna element having a proximal end and a distal end, wherein the proximal ends of the conductive arms of said second conductive antenna element are disposed in proximity to one another in a central region of said second conductive antenna element;

a third RF switch connected between the proximal end of said first conductive arm of said second conductive antenna element and said second conductive member;

a fourth RF switch connected between the proximal end of said second conductive arm of said second conductive antenna element and said second conductive member; and a switching circuit electrically or optoelectrically coupled to said first, second, third and fourth RF switches, wherein said switching circuit turns said RF switches on and off in such a manner that said first and second conductive arms of said first and second conductive antenna elements are variably connected to and disconnected from said first and second conductive members to achieve phase shifts in increments of $2\pi/N$ radians, where N equals the number of conductive arms comprised by either of said first or second conductive antenna elements of said antenna phase shifter.

10. The antenna phase shifter of claim 9 wherein said RF switches are diodes.

11. The antenna phase shifter of claim 9 wherein said RF switches are optoelectronic switches.

12. An antenna phase shifter for connection to a balanced transmission line comprising a first conductive line and a second conductive line, said antenna phase shifter comprising:

a thin layer of dielectric material having a top surface and a bottom surface;

a conductive antenna element disposed on the top surface of said layer of dielectric material, said conductive antenna element being a planar frequency-independent antenna having a spatial phase pattern, wherein said conductive antenna element is comprised of a plurality of conductive arms, each of said conductive arms having a proximal end and a distal end, wherein the proximal ends of the conductive arms are disposed in proximity to one another in a central region of said conductive antenna element;

each of said conductive arms having a first RF switch connected between the proximal end and said first conductive line, a second RF switch connected between the proximal end and said second conductive line, and, a bias-control switch connected to the distal end, the bias-control switch selectively applying a bias voltage to the distal end; and said conductive arms being selectively coupled to the first and second conductive lines via the first and second RF switches by the application of the bias voltage to the distal ends of the conductive arms, the conductive arms being selectively coupled to the first and second conductive lines to radiate and receive an RF signal, the RF signal having phase shifts in increments of $2\pi/N$ radians, where N equals the number of conductive arms comprised by said conductive antenna element.

13. The antenna phase shifter of claim 12 wherein said RF switches are diodes.

14. The antenna phase shifter of claim 12 wherein said RF switches are optoelectronic switches.

15. An antenna phase shifter for connection to a balanced transmission line comprising a first conductive line and a second conductive line, said antenna phase shifter comprising:

a thin layer of dielectric material having a top surface and a bottom surface;

a first conductive antenna element disposed on the top surface of said layer of dielectric material, said first conductive antenna element being a planar frequency-independent antenna having a spatial phase pattern, wherein said first conductive antenna element is comprised of a plurality of conductive arms, each of said conductive arms having a proximal end and a distal end, wherein the proximal ends of the conductive arms are disposed in proximity to one another in a central region of said first conductive antenna element;

each of said conductive arms of the first conductive antenna element having an RF switch connected between its proximal end and said first conductive line;

a second conductive antenna element disposed on the bottom surface of said layer of dielectric material, said second conductive antenna element being a planar frequency-independent antenna identical and aligned to said first conductive antenna element, wherein said second conductive antenna element is comprised of a plurality of conductive arms, each of said conductive arms of said second conductive antenna element having a proximal end and a distal end, wherein the proximal ends of the conductive arms of said second conductive antenna element are disposed in proximity to one another in a central region of said second conductive antenna element;

each of said conductive arms of said second conductive antenna element having an RF switch connected between its proximal end and said second conductive line; and a switching circuit electrically or optoelectrically coupled to each of said RF switches, wherein said RF switches are turned on and off by the switching circuit in such a manner that said conductive arms are variably connected to and disconnected from the conductive lines, to which said conductive arms are coupled via said RF switches, by the RF switches directly and by proximity effect between the aligned conductive arms of the first and second conductive antenna elements, to achieve phase shifts in increments of $2\pi/N$ radians, where N equals the number of conductive arms comprised by said first conductive antenna element.

16. An antenna having phase shifting for connection to a balanced transmission line, comprising:

a thin layer of dielectric material having a top surface and a bottom surface;

a conductive antenna element disposed on the top surface of the layer of dielectric material, the conductive antenna element having a plurality of conductive arms, each of the conductive arms having a proximal end and a distal end, wherein the proximal ends of the conductive arms are disposed in proximity to one another in a central region of the conductive antenna element;

a first conductive line for coupling to an RF transceiver device, the first conductive line being selectively coupled to the conductive arms via a plurality of first RF switches;

a second conductive line for coupling to the RF transceiver device, the second conductive line being selectively coupled to the conductive arms via a plurality of second RF switches;

a plurality of bias-control switches coupled to the distal ends of the conductor arms, the bias-control switches selectively applying one of a forward bias voltage and a reverse bias voltage to the distal ends, thereby causing the selective coupling of the first and second conductive lines to the conductive arms via the first and second RF switches to achieve phase shifts in increments of $2\pi/N$ radians, where N equals the number of conductive arms comprised by the conductive antenna element;

a first capacitive device disposed in the first conductive line and a second capacitive device disposed on the second conductive line, the first and second capacitive devices blocking the forward and reverse bias voltages from the RF transceiver device; and a first inductive device configured to be coupled between the first conductive line and a ground connection, and a second inductive device configured to be coupled between the second conductive line and the ground connection, the first and second inductive devices providing a signal pathway for a bias current.

* * * * *